US006779285B2

(12) United States Patent
Heinz et al.

(10) Patent No.: US 6,779,285 B2
(45) Date of Patent: Aug. 24, 2004

(54) TROUGH MANGLE

(75) Inventors: Engelbert Heinz, Vlotho (DE); Wilhelm Bringewatt, Porta Westfalica (DE)

(73) Assignee: Kannegiesser Aue GmbH, Schlema (DE)

( * ) Notice: Subject to any disclaimer, the term of this patent is extended or adjusted under 35 U.S.C. 154(b) by 32 days.

(21) Appl. No.: 10/072,022

(22) Filed: Feb. 7, 2002

(65) Prior Publication Data

US 2002/0148145 A1 Oct. 17, 2002

(30) Foreign Application Priority Data

Feb. 14, 2001 (DE) ..... 101 07 120
Oct. 16, 2001 (DE) ..... 101 52 641

(51) Int. Cl.[7] ..... D06F 67/00
(52) U.S. Cl. ..... 38/59
(58) Field of Search ..... 100/155 R, 156, 100/163 R, 168, 169, 170, 172; 226/188, 190, 194, 174, 175, 182; 38/44, 59, 45, 46, 52, 56, 58, 66, 47, 60, 61; 254/344

(56) References Cited

U.S. PATENT DOCUMENTS 2,657,483 A * 11/1953 Zwaard ..... 38/58
3,791,056 A * 2/1974 Inoue et al. ..... 38/56
4,283,868 A * 8/1981 Geiger ..... 38/56
4,584,747 A * 4/1986 Katterbach et al. ..... 38/63
4,763,031 A * 8/1988 Wang ..... 310/83
4,787,157 A * 11/1988 Ferrage et al. ..... 38/56
5,438,776 A * 8/1995 Lapauw ..... 38/47
5,598,649 A * 2/1997 Geiger ..... 38/46
5,897,105 A * 4/1999 Huggett et al. ..... 254/344

FOREIGN PATENT DOCUMENTS

| | | |
|---|---|---|
| DE | 748 366 C | 2/1953 |
| DE | 38 19 378 A | 12/1989 |
| DE | 90 04 179 U | 7/1990 |
| EP | 0 175 900 A | 4/1986 |
| EP | 0 573 402 A | 12/1993 |
| WO | WO 93 06292 A | 4/1993 |

* cited by examiner

*Primary Examiner*—Ismael Izaguirre
(74) *Attorney, Agent, or Firm*—Technoprop Colton LLC

(57) ABSTRACT

A trough mangle with a mangle roll having a diameter that is enlarged as compared with conventional trough mangles in which the only one mangle roll enlarged in diameter leads to a disproportionate increase in the mangling performance.

38 Claims, 7 Drawing Sheets

TROUGH MANGLE

BRIEF SUMMARY OF THE INVENTION

BACKGROUND OF THE INVENTION

1. Technical Field

The invention relates to a trough mangle having a mangle roll that can be driven so as to revolve and a flexide mangle trough associated with the mangle roll.

2. Prior Art

The invention pertains to trough mangles, which are used in commercial laundries. Here, the mangling performance of such mangles is critical. High mangling outputs are achieved in known trough mangles by the latter being provided with two or an even larger number of mangle rolls located one after another. Each individual mangle roll is assigned a curved mangle trough. The pieces of laundry are moved along on the successive mangle troughs by the mangle rolls. In order to transfer the pieces of laundry from one mangle trough to the other, curved bridges are arranged between successive mangle troughs. In order to move the pieces of laundry along on the bridges, conveying means are provided, which are usually mangle belts, as they are known. The bridges and the mangle belts require extra expenditure during the production of such trough mangles. Furthermore, during the transfer of the pieces of laundry from one mangle trough to the other in the region of the bridges and the mangle belts, malfunctions may occur which, in the extreme case, lead to interruptions to the mangling operation. Finally, the mangle belts leave imprints on the laundry which, above all in the case of table linen, spoil the visual appearance.

On the basis of the above, the invention is based on the object of providing a trough mangle for commercial laundries in particular which has a high mangling performance but does not have the disadvantages cited at the beginning.

A trough mangle to achieve this object has a mangle roll (10) that can be driven so as to revolve and a flexible mangle trough (12) associated with the mangle roll, wherein the mangle roll (10) has a diameter which is greater than 1600 mm. The fact that the mangle roll has a diameter which is greater than 1600 mm, in particular in the range between 1600 and 2600 mm, preferably between 1800 and 2400 mm, permits the performance of a trough mangle to be increased without additional mangle rolls. Surprisingly, it has been shown that the mangling performance in the trough mangle according to the invention may be doubled without the roll diameter being twice as large. The mangle performance of a conventional trough mangle with two mangle rolls which, for example, have a diameter of 1300 mm, can be achieved in the case of the trough mangle according to the invention with a single mangle roll whose diameter is around 2000 mm. This is associated in particular with the fact that the resilient behavior of the mangle trough in the circumferential direction of the mangle roll is improved at greater roll diameters. In addition, the loss of smoothing path along the bridges between successive mangle rolls and the loss of evaporation performance are dispensed with. Increasing the mangle performance by means of a mangle roll of a greater diameter instead of the previous sequence of a plurality of mangle rolls also leads to bridges between successive mangle troughs and, in particular, mangle belts susceptible to faults no longer being required.

The trough mangle according to the invention can also have a plurality of successive mangle rolls and mangle troughs with diameters of more than 1600 mm, in order to increase the mangle performance further. Although the pieces of laundry then also have to be transferred from one mangle trough to the other, as a result of the larger mangle rolls, the number of mangle rolls and mangle troughs can be reduced, so that a lower number of transfer operations of the pieces of laundry to following mangle troughs is required, which also leads to a reduction in the expenditure on construction and the susceptibility of such a trough mangle to faults.

A further trough mangle for achieving the object cited at the beginning or for developing the trough mangle described previously wherein a drive side of the mangle roll is assigned a drive, and the drive carries the mangle roll (10) on the drive side (33). Accordingly, the end of the mangle roll which is associated with a drive (drive side) is carried by the drive. In particular, the drive side of the mangle roll is mounted in the drive unit. This renders a separate bearing for the mangle roll on the drive side superfluous. In addition, the structural dimensions are reduced, since as a result of the missing separate bearing on the drive side, the drive can be placed closer to the relevant end of the mangle roll.

The drive side of the mangle roll is preferably mounted on an output drive shaft of the drive, specifically in particular of a gearbox belonging to the latter. Because of its design, the output drive shaft of the gearbox has an internal mounting which is suitable to absorb the bearing forces of the mangle roll on the drive side.

The mangle roll is connected to the drive, in particular the gearbox, via a coupling flange, according to a preferred refinement of the invention. This separate coupling flange may be provided with a torque-transmitting means to be connected to the gearbox and can be flange-mounted on the relevant end of the mangle roll in a simple way by means of screws. This makes it possible to achieve a connection between the drive, in particular the gearbox, and the mangle roll which can be produced simply and easily replaced if required.

A further trough mangle for achieving the object cited at the beginning or for developing the trough mangle having at least one mangle roll (10) that can be driven so as to revolve and a flexible mangle trough (12) associated with the mangle roll (10), wherein a drive (32) of the mangle roll (10) has a gearbox which is designed as an epicyclic gearbox, an angled epicyclic gearbox (36), a cyclo gearbox or a harmonic drive gearbox Accordingly, the gearbox of the drive is designed as an epicyclic gearbox. This makes it possible to reduce the drive speed of a motor, in particular of an electric motor, to the relatively low rotational speed of the mangle roll which, in particular, has a large diameter. The epicyclic gearbox makes it possible to implement large step-down ratios with small structural dimensions. Furthermore, the output drive shaft of the epicyclic gearbox has a relatively high load bearing capacity, which permits the mangle roll on the drive side to be mounted directly on the output drive shaft of the epicyclic gearbox. Use is preferably made of an angled epicyclic gearbox. As a result, the electric motor serving to drive the mangle roll can be flange-mounted on the angled epicyclic gearbox with a longitudinal axis oriented at right angles to the longitudinal axis of the mangle roll. This leads to a particularly compact structural configuration of the drive side of the trough mangle. In addition, the gearbox may alternatively also be a cyclo gearbox or a harmonic drive gearbox.

A further solution of the object cited at the beginning, which can also be used to develop the trough mangle having at least one mangle roll (10) that can be driven so as to revolve and a flexible mangle trough (12) associate with the mangle roll (10), wherein, on the drive side (33) and on the non-driven side (34) opposite the latter, the mangle roll (10) is connected to a frame (15) such that it can pivot, in each case via a lever mechanism (30, 31). Accordingly, the mangle roll is pivotably connected to a frame, in each case via a lever mechanism, both on the drive side and on the opposite side, namely the drive-free side. The lever mechanisms make it possible to connect even mangle rolls with large diameters and correspondingly high weights, but also with high contact forces on the mangle trough to the frame in a stable manner.

According to a preferred development of the invention, the lever mechanisms of the drive side and of the drive-free side are coupled to one another. This is preferably done by means of a compensating shaft. As a result, synchronization of the lever mechanisms associated with the opposite ends of the mangle roll is implemented, so that the mangle roll can be moved up and down without the longitudinal mid-axis of the mangle roll changing its direction in the process.

In a preferred refinement of the trough mangle according to the invention, the compensating shaft is arranged on a pivot axis of such a lever that belongs to each lever mechanism and on which the mangle roll is mounted. As a result, the compensating shaft can be a constituent part of the pivotable mounting of the lever mechanisms, and at the same time, connect the levers in such a way that they are pivoted to the same extent, the compensating shaft being rotatable about its longitudinal mid-axis, forming the pivots for the levers. The compensating shaft is preferably dimensioned and constructed in such a way that it is substantially free of torsion.

According to a preferred development of the invention, the weight of the drive mounted on the lever mechanism on the drive side can be compensated for, to be specific in particular geometrically or mechanically and/or hydraulically or pneumatically. The mangle roll, whose diameter is relatively large, requires a powerful drive. This drive, to be specific in particular the angled epicyclic gearbox as well, has a weight which has a noticeable effect on the contact force of the mangle roll against the mangle trough. Since this weight, caused by the dead weight of the drive, is present only on the drive side, according to the invention, it is compensated for by the contact force of the mangle roll on the mangle trough, exerted by the lever mechanism on the drive-free side, being increased on the opposite side in accordance with the weight of the drive. This is done either geometrically or mechanically, by that lever of the lever drive on which a pressure-medium cylinder acts in order to press the mangle roll onto the mangle trough being correspondingly longer on the drive-free side than on the drive side. Alternatively, or additionally, however, the compensation for the weight of the drive can also be carried out hydraulically or pneumatically, for example by the pressure-medium cylinder on the drive-free side having a greater piston area and, as a result, producing a contact force of the mangle roll against the mangle trough which is higher by the weight of the drive. However, the pressure-medium cylinders can also have different pressures applied to them. The piston areas of the pressure-medium cylinders can then also be equally large, that is to say identical pressure-medium cylinders can be used.

A further trough mangle for achieving the object cited at the beginning or else for developing the trough mangle having in particular a mangle roll (10) that can be driven so as to revolve and a flexible mangle trough (12) associated with the mangle roll (10), wherein the resilient mangle trough (12) is formed of trough sections connected to one another. Accordingly, the resilient mangle trough is formed from trough sections connected to one another. The preferably equally large trough sections of the mangle trough surrounding the mangle trough in some areas, preferably in the area of a lower half, thus extend only over part of the circumference of the mangle roll which is surrounded by the entire mangle trough. In the longitudinal direction of the mangle roll, on the other hand, each trough section extends over the entire length of the mangle roll. Dividing the mangle trough in the circumferential direction in accordance with the invention does not have a noticeable influence on the stability of said trough, but a certain flexibility or resilience is maintained. In the longitudinal direction of the mangle roll, on the other hand, in which the mangle trough is preferably intended to be rigid, the rigidity is maintained, since in this direction the mangle trough is not divided.

Furthermore, provision is made to construct the individual trough sections intrinsically independently. This applies in particular with regard to their (heating) energy supply. Consequently, each trough section has its own connections for the feed and discharge of the (heating) energy, for example, steam, hot oil or the like. As a result, in order to form the mangle trough, the trough sections merely have to be connected to one another.

According to a preferred refinement of the invention, the mangle trough is assembled from two equally large trough sections, each of which extends over approximately one quarter of the circumference of the mangle roll. The two trough sections are connected to each other in the middle (in relation to the circumferential direction of the mangle roll), that is to say approximately at the lower vertex of the semicircular mangle trough. This connection is provided by at least one welded seam running continuously in the longitudinal direction of the mangle trough. This welded seam is designed and dimensioned such that it has a section modulus which corresponds to the section modulus of the usually double-walled trough sections, so that the resilient behavior of the trough mangle assembled from the trough sections is approximately equally large in the area of the connection between the trough sections as in the adjacent areas of the mangle trough which is formed by the trough sections. This means that the mangle trough formed from the welded-together trough sections has an approximately equal section modulus over its entire course and, as a result, has an equal flexional behavior over the entire circumference of the mangle roll, as a result of which, when the mangle roll is pressed into the mangle trough, the mangle trough everywhere nestles uniformly against the mangle roll.

A further trough mangle for achieving the object having in particular a mangle roll (10) that can be driven so as to revolve and a flexible mangle trough (12) associated with the mangle roll (10), wherein the angle roll (10) has a wrapping which has a thickness between 6 and 25mm. This may also be a development of the mangle troughs described previously. Accordingly, the mangle roll is provided with a wrapping, which has a thickness between 6 an 25 mm, in particular 12 to 20 mm. Such a wrapping withstands the loadings which arise when a relatively large mangle roll is pressed against the mangle trough.

The wrapping is preferably formed in one layer, but this does not rule out the single-layer wrapping intrinsically being formed from a plurality of layers. The single-layer wrapping is closed endlessly in the circumferential direction of the mangle roll by a substantially transition-free or at least a virtually offset-free connecting seam. As a result, the wrapping of the mangle roll presses the pieces of laundry to be smoothed uniformly onto the smoothing surface of the mangle trough at all points on the circumference of the mangle roll. The wrapping formed in this way also withstands the high pressures which the mangle roll exerts on the mangle trough.

The wrapping is preferably formed from a felt or felt-like material. This has the requisite spring characteristics, because of the thickness specially selected according to the invention, as a result of which, in the wrapping of the trough mangle according to the invention, it is possible to dispense with the springs which are common in conventional trough mangles and which would not withstand the pressures, or not withstand them permanently, which arise in the case of trough mangles with large diameters of the mangle rolls. If appropriate, however, the (highly-loadable) springs that withstand the loadings which arise can be provided.

BRIEF DESCRIPTION OF THE DRAWINGS

A preferred exemplary embodiment of the trough mangle according to the invention will be explained in more detail using the drawing, in which.

DETAILED DESCRIPTION OF THE PREFERRED EMBODIMENTS

The figures show a trough mangle for commercial laundries. The trough mangle has a cylindrical mangle roll 10, which can be driven so as to rotate about a longitudinal mid-axis 11. The mangle roll 10 shown here has, according to the invention, a diameter of about 2000 mm. The mangle roll 10 is associated with a flexible mangle trough 12. The mangle trough 12 surrounds approximately the lower half of the mangle roll 10, so that the mangle trough 12 is approximately semicircular in cross section.

Figure 1:
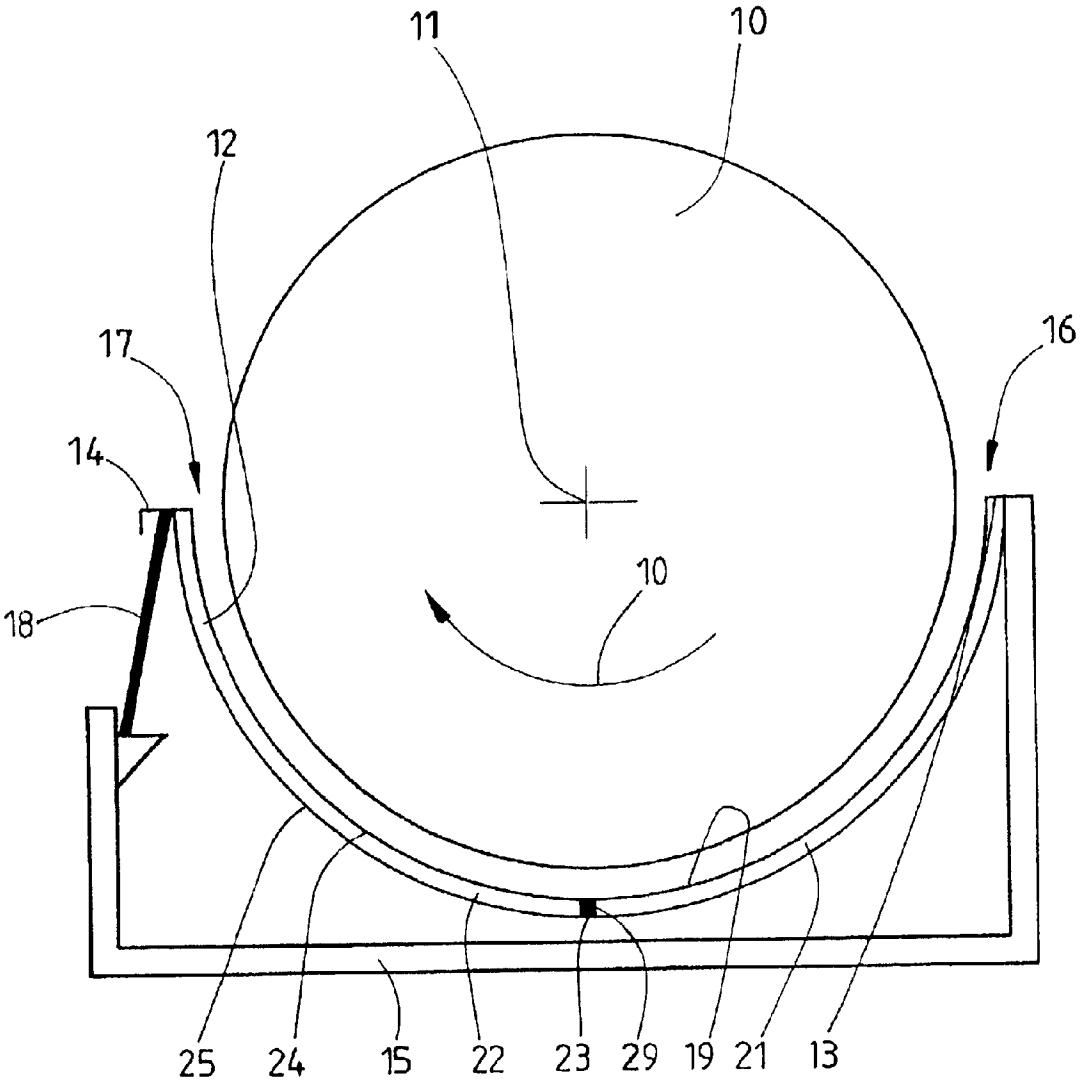
FIG. 1 shows a schematic side view of the trough mangle.
Figure 2:
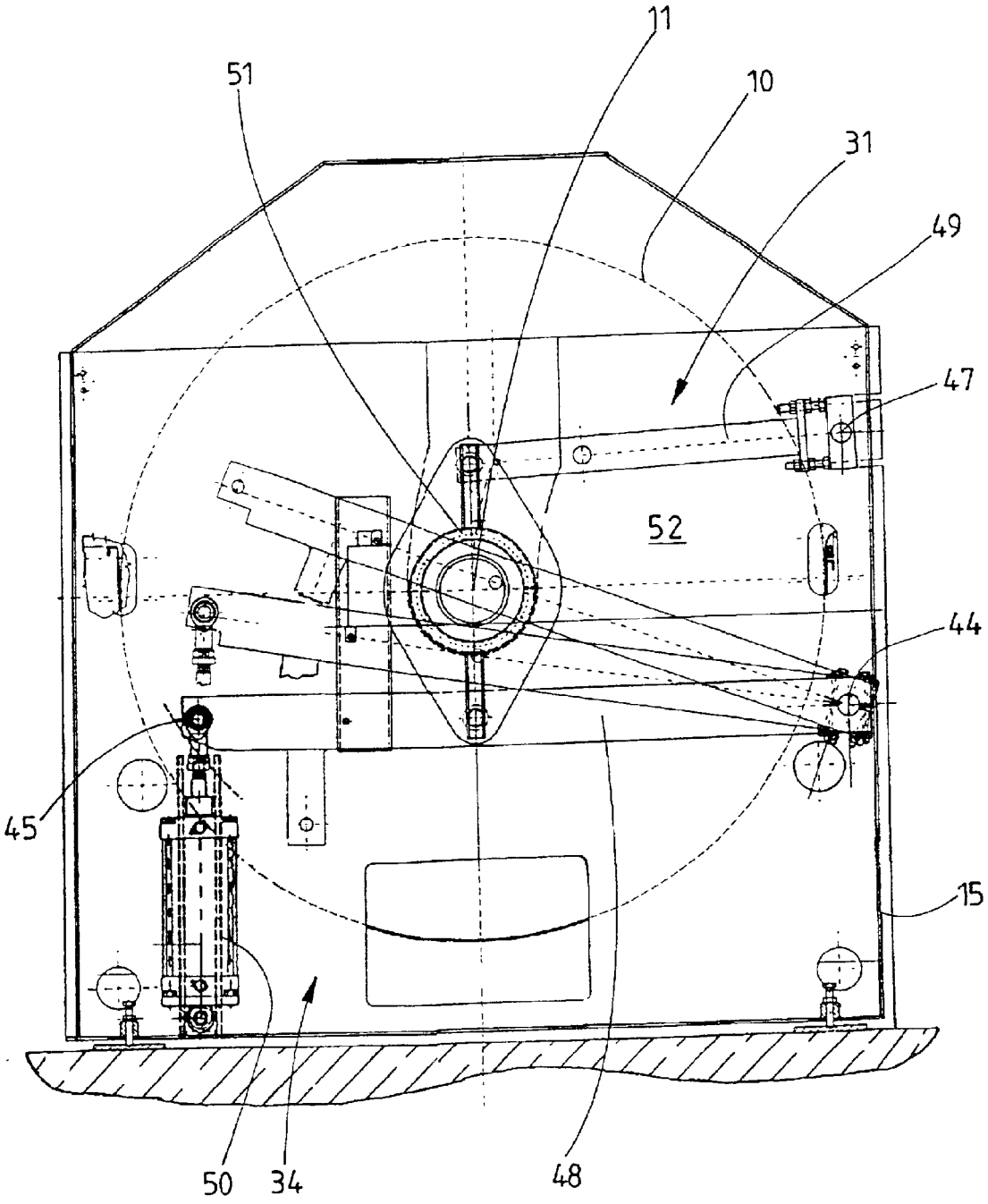
FIG. 2 shows a view of a non-driven side of the trough mangle.
Figure 3:
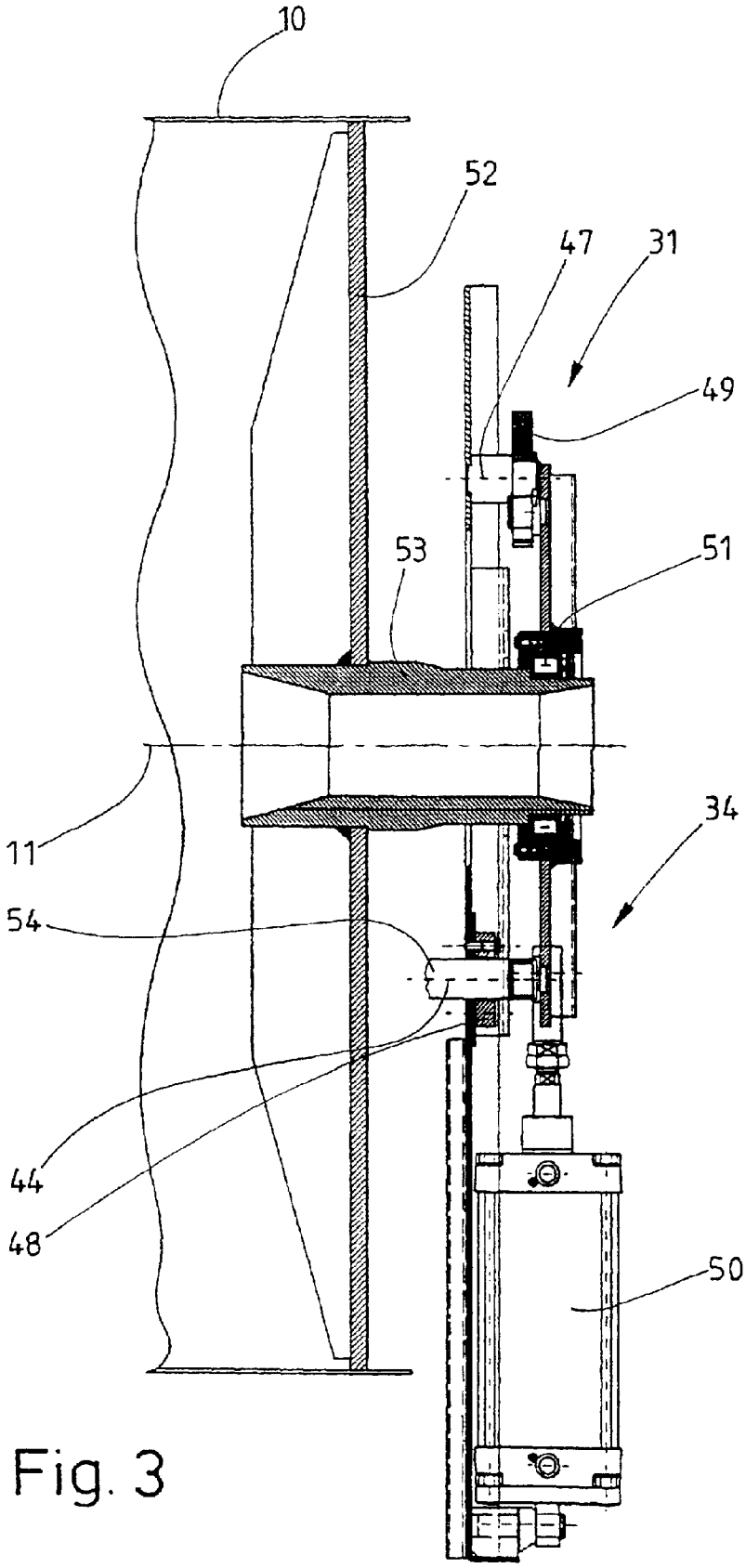
FIG. 3 shows a longitudinal section (along a longitudinal mid-axis of the mangle roll) of the non-driven side of the trough mangle.
Figure 4:
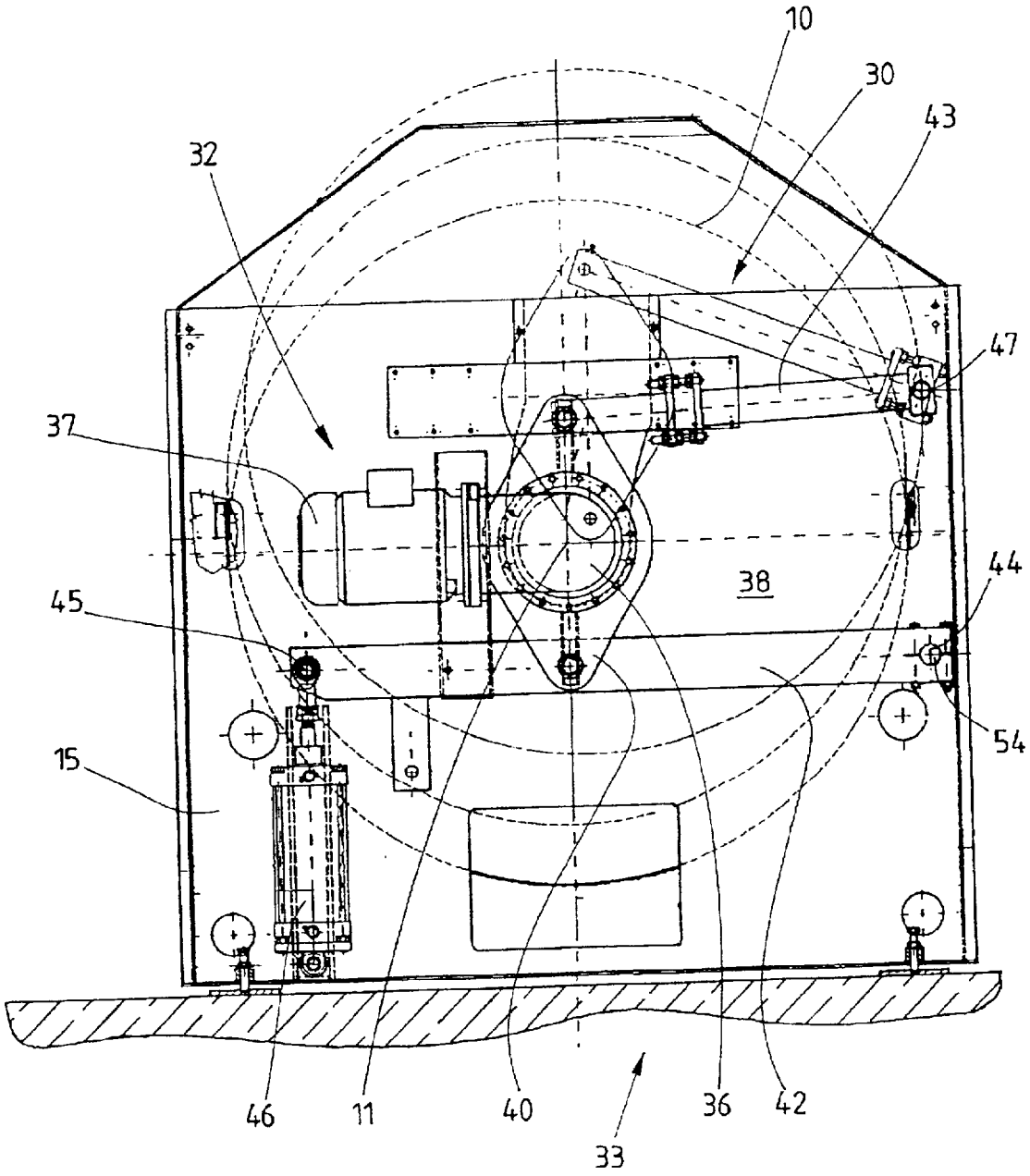
FIG. 4 shows a view of a drive side of the trough mangle.
Figure 5:
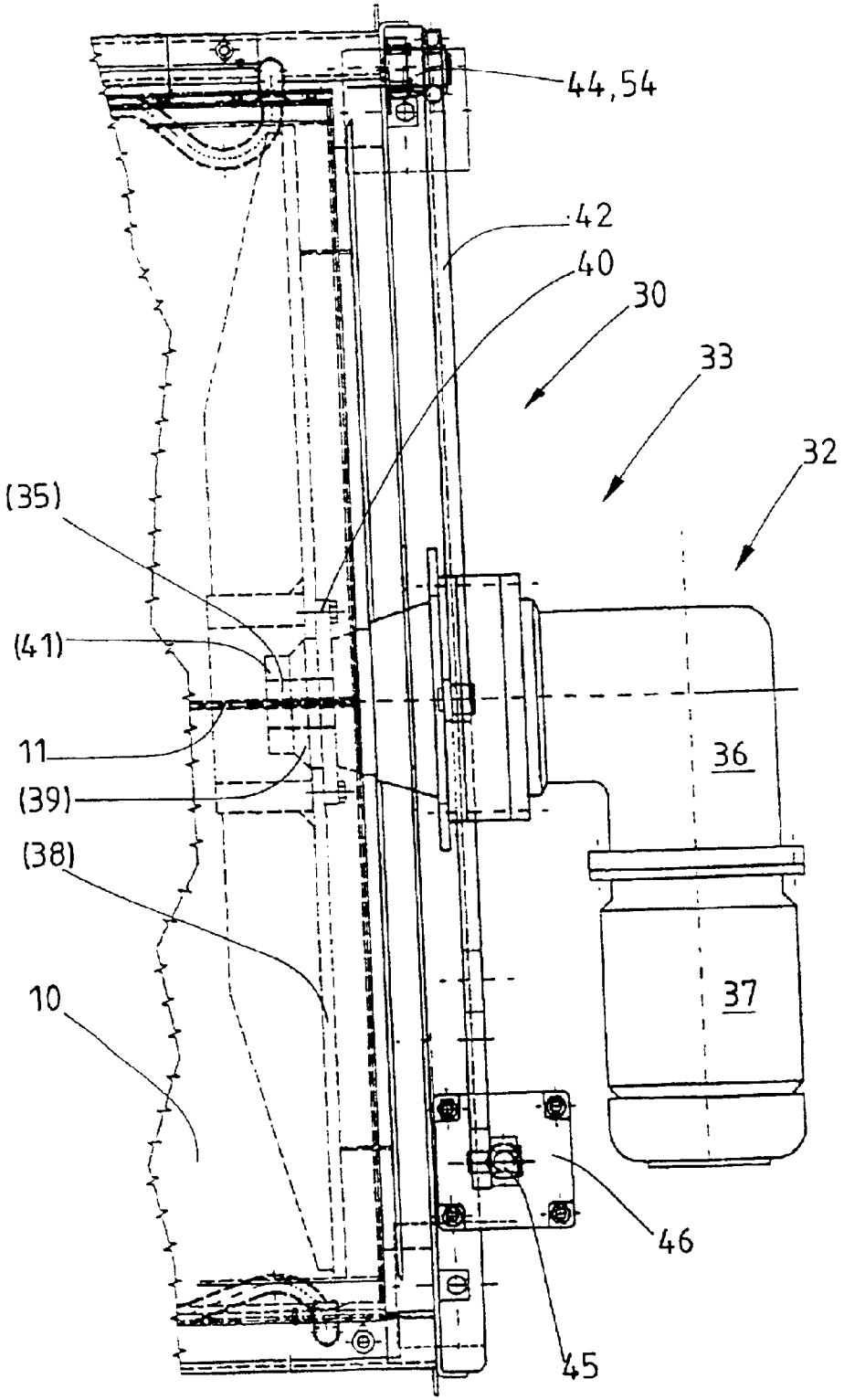
FIG. 5 shows a view of the drive side with a drive.
Figure 6:
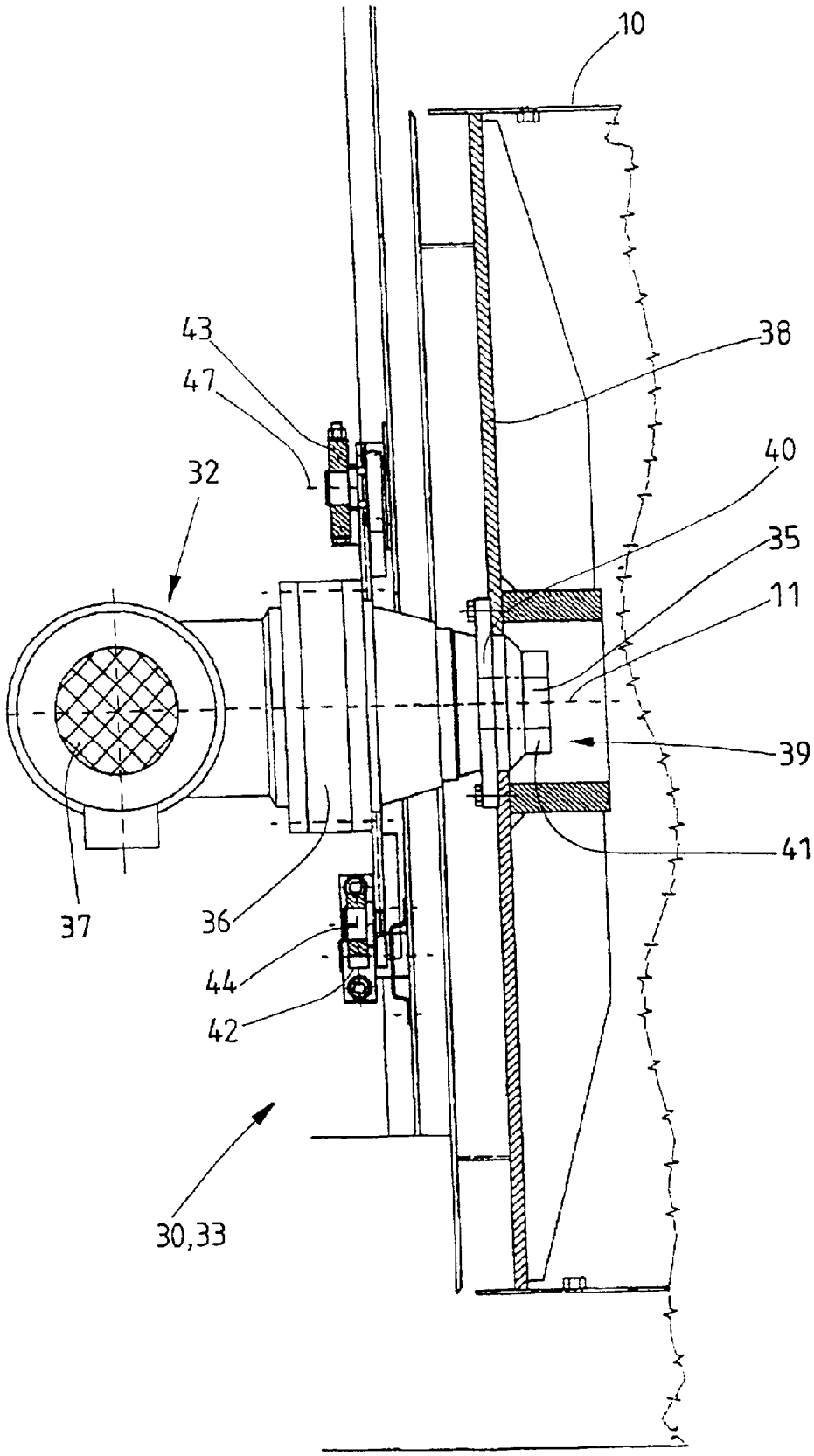
FIG. 6 shows a vertical longitudinal section through the drive side.
Figure 7:
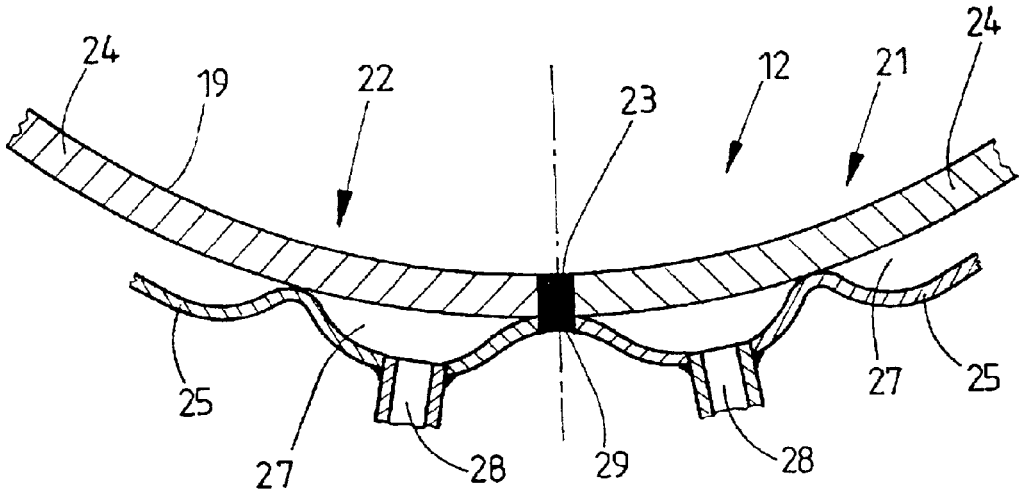
FIG. 7 shows an enlarged detail of a cross section through the mangle trough in the area of the connection of the trough halves.
Figure 8:
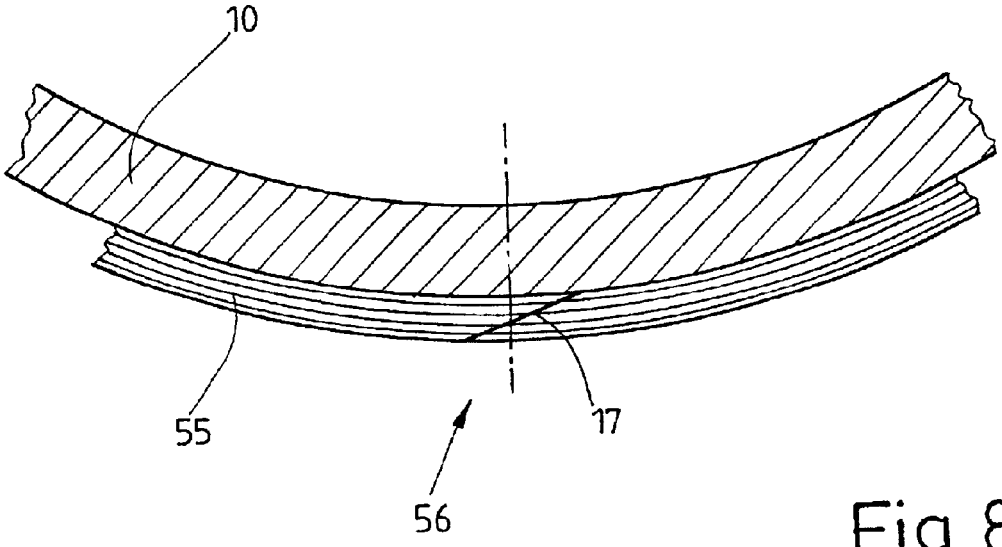
FIG. 8 shows an enlarged detail of a cross section through the mangle roll with a wrapping.

At opposite longitudinal edges 13 and 14, the mangle trough 12 is preferably continuously mounted on a fixed frame 15 of the trough mangle. The right-hand longitudinal edge 13 of the mangle trough 12 in FIG. 1 is associated with an inlet side 16 of the trough mangle and is firmly connected to the frame 15. The opposite longitudinal edge 14 on an outlet side 17 is mounted on the frame 15 such that it can move on the frame 15, via a slightly skewed swinging support 18 which is preferably continuous in the longitudinal direction of the mangle trough 12. This mounting can be designed in the manner according to DE 197 02 644 A1, to whose entire content reference is made which reveals details of the mounting, in particular the swinging support 18.

In the area of the inlet side 16 and the outlet side 17, the mangle trough 12 can be provided with an extension pointing upward, which runs rectilinearly and is aligned somewhat obliquely, to be specific in such a way that the longitudinal edges 13 and 14 are at a distance from the mangle roll 10 in order to form a gap on the inlet side 16 and the outlet side 17. Such a gap primarily makes it easier to insert the pieces of laundry to be mangled between the mangle roll 10 and the mangle trough 12. The resilient mangle trough 12 nestles against the cylindrical surface of the mangle roll 10 in the semicircular area, so that the pieces of laundry are moved along through the trough mangle between the mangle roll 10 and an inner smoothing surface 19 of the mangle trough 12 by means of the mangle roll 10, driven in a clockwise direction (drive direction 20) in the exemplary embodiment shown. The gap shown in FIG. 1 between the mangle trough 12 and the mangle roll 10 merely serves for illustrative purposes and explanatory purposes; in actual fact, it is not present during operation of the trough mangle.

The resilient mangle trough 12 is formed of two trough halves 21 and 22 in the trough mangle shown here. Each of the trough halves 21 and 22, running uninterruptedly over the entire longitudinal direction of the trough mangle, extends approximately over a quarter of the circumference of the cover of the mangle roll 10. The trough halves 21 and 22 are connected by a connecting line 23 running through in the longitudinal direction of the mangle roll 10. The connecting line 23 extends on a vertical longitudinal mid-plane of the trough mangle lying on the longitudinal mid-axis 11 of the mangle roll 10. Apart from their mirror-image arrangement about the longitudinal mid-axis of the trough mangle, the two trough halves 21 and 22 are of substantially identical design.

Each trough half 21 and 22 is double-walled. For this purpose, each trough half 21 and 22 has a thicker inner trough plate 24 and a thinner outer trough plate 25. The inner sides of the inner trough plates 24 of each trough half 21 and 22, pointing toward the mangle roll 10, together form the smoothing surface 19 of the mangle trough 12. The trough plates 24 and 25 are formed from high-grade steel, in particular stainless steel. The equally thick inner trough plates 24 of the trough halves 21 and 22 are about 2 to 3½ times as thick as the likewise equally thick outer trough plates 25 of the trough halves 21 and 22. The thickness of the inner trough plates 24 lies in the range from 4 to 6 mm. Accordingly, the outer trough plates 25 are 1.2 to 3 mm thick.

To form the respective trough halves 21 and 22, the inner trough plate 24 and the outer trough plate 25 of the same are welded tightly all around at the edge. Furthermore, the areas of the trough halves 21 and 22 are provided with a preferably uniform grid of connecting points 26. In the areas of the connecting points 26, the inner trough plates 24 are additionally welded to the outer trough plates 25. Between the individual connecting points 26, the outer trough plates 25 are spaced apart from the inner trough plates 24, to be specific approximately by an amount which corresponds to the thickness of the outer trough plates 25, preferably being somewhat less. In those areas in which the trough plates 24 and 25 are spaced apart from each other, flow ducts 27 to lead heating medium through, in particular steam or a heated liquid (hot oil) are formed within the respective trough half 21 and 22. Alternatively, it is conceivable to connect the trough plates 24 and 25 to each other by means of longitudinal seams or transverse seams in the area of the surface of the trough halves 21 and 22. The connection of the trough plates 24, 25 both along the circumference and at the connecting points 26 and longitudinal or transverse seams is carried out by means of welding, to be specific, preferably laser welding.

Each of the two trough halves 21 and 22 is designed independently with regard to the supply of energy. To this end, the trough half 21 has, at the upper edge region, pointing toward the inlet side 16, and the trough half 22 has, at the upper edge region pointing toward the outlet side 17, at least one, preferably a plurality of, steam connections. At the lower edge, close to the connecting line 23, each trough half 21 and 22 has connections 28 to discharge condensate. Each trough half 21 and 22 preferably has a plurality of separate connections 28. In the exemplary embodiment shown, each trough half 21 and 22 has five connections 28 to discharge condensate. If required, each trough half 21 and 22 can also have more than five connections 28. Likewise, less than five connections can be provided if appropriate.

At the connecting line 23 running continuously in the longitudinal direction of the trough mangle, edges of the trough halves 21 and 22 that are directed toward one another are welded to one another, to be specific by means of a longitudinal welded seam 29, which if required can be formed from a plurality of individual welded seams produced one after another. The longitudinal welded seam 29 is produced in accordance with a suitable, known arc welding method, under inert gas. If appropriate, however, other welding methods can also be used for this purpose. In one embodiment of the invention, the longitudinal welded seam 29 extends over the entire thickness of the adjacent edges of the trough halves 21 and 22, specifically over the sum of the thickness of the inner trough plate 24 and of the outer trough plate 25, which, in the area of the connecting line 23 or longitudinal welded seam 29, rest continuously on each other in the longitudinal direction of the trough mangle, since they have already been welded to form the trough halves 21 and 22 by means of the welded seam surrounding each trough half 21 and 22 all around. Alternatively, it may be sufficient for the longitudinal welded seam 29 to extend only over the thickness of the inner trough plate 24 and not of the outer trough plate 25 as well. On the inner side of the mangle trough 12, the longitudinal welded seam 29 is subsequently machined, by means of grinding and/or polishing, for example, in such a way that a transition-free connection between the inner surface of the inner trough plates 24 of the individual trough halves 21 and 22 is produced, and therefore a continuous smoothing surface 19 also in the area of the connecting point 26.

At each of its two opposite ends, the mangle roll 10 is connected to the frame 15 via a lever mechanism 30, 31. By means of the lever mechanisms 30 and 31, the mangle roll 10 can be pressed into the mangle trough 12 and, if required, moved away from the same. One end of the mangle roll 10 is assigned a drive 32. This side of the mangle roll 10 will be referred to below as the drive side 33. The opposite end of the mangle roll 10, which is not assigned a drive, will be referred to as the non-driven side 34. This side is assigned the lever drive 31.

On the drive side 33, the mangle roll 10 is mounted directly on the drive 32 without a stub axle, specifically on an output drive shaft 35 of a gearbox belonging to the drive. This gearbox is designed as an angled epicyclic gearbox 36. The angled epicyclic gearbox 36 has a transmission ratio (i) of 200 to 350, preferably about 300. As a result, in spite of the relatively large diameter of about 2000 mm, a circumferential speed is achieved with the mangle roll 10 which corresponds approximately to that which can be achieved in conventional trough mangles with a mangle roll of smaller diameter, namely at about 45 m/min. On the drive side 33, the mangle roll 10 is mounted on the output drive shaft 35 of the angled epicyclic gearbox 36, said shaft being formed as splined shaft. The angled epicyclic gearbox 36 in the exemplary embodiment shown is driven by an electric motor 37. The electric motor 37 is flange-mounted on the angled epicyclic gearbox 36 in such a way that the longitudinal mid-axis of the electric motor 37 intersects the longitudinal mid-axis 11 of the mangle roll 10 so as to be oriented approximately horizontally, to be specific at a right angle, by the longitudinal mid-axis of the electric motor 37 running transversely with respect to the longitudinal mid-axis 11 of the mangle roll 10.

On the drive side 33, a coupling flange 39 is assigned to an end wall 38 of the mangle roll 10. A flange plate 40 resting on the outside of the end 38 of the mangle roll 10 and belonging to the coupling flange 39 is screwed to the end wall 38. A splined profile 41 is machined into the flange plate 40 of the coupling flange 39. The splined profile 41 in the flange plate 40 is formed so as to correspond with the profile of the output drive shaft 35 of the angled epicyclic gearbox 36, likewise formed as a splined profile. By plugging the output drive shaft 35 of the angled epicyclic gearbox 36 into the splined profile of the plug-on sleeve 41, a torque-transmitting connection is made between the output drive shaft 35 of the angled epicyclic gearbox 36 and the mangle roll 10 on the drive side 33. The plug-on sleeve 41, in particular the splined profile of the same, is arranged concentrically with the longitudinal mid-axis 11 of the mangle roll 10 as a result of which the latter can be driven by the drive 32 so as to rotate about the longitudinal mid-axis 11.

The lever mechanisms 30, 31 on opposite sides of the mangle roll 10 are designed equally, in conceptional terms, as parallelogram link mechanisms. However, the lever mechanisms 30, 31 in the exemplary embodiment shown have different dimensions.

The lever mechanism 30 on the drive side 33 has a (lower) double lever 42 and a single lever 43 located at a distance above it. The double lever 42 is mounted on the frame 15 at an outer end such that it can pivot about a pivot 44. The pivot 44 runs parallel to the longitudinal mid-axis 11 of the mangle roll 10. The pivot 44 is located beside and below the longitudinal mid-axis 11. At an end opposite the pivot 44, the double lever 42 is connected in an articulated manner to a piston-rod end 45 of a pneumatic cylinder 46. A piston underside of the pneumatic cylinder 46 is pivotably mounted on the frame 15. Between the pivot 44 at one end of the double lever 42 and the piston-rod end 45 at the other end of the double lever 42, the drive, specifically the angled epicyclic gearbox 36, is mounted on the double lever 42. Furthermore, the angled epicyclic gearbox 36 is mounted at a free end of the single lever 43. The opposite free end of the single lever 43 is mounted on the frame 15 such that it can pivot about a pivot 47. This pivot 47 is located laterally beside and above the longitudinal mid-axis 11 of the mangle roll 10, specifically, in the exemplary embodiment shown, approximately vertically above the pivot 44 for the double lever 42. By retracting and extending the pneumatic cylinder 46, the double lever 42 is pivoted about the pivot 44 and, at the same time, the drive 32 with the drive side 33 of the mangle roll 10 fixed to it is raised or lowered. Accordingly, the single lever 43 also connected to the drive 32 is pivoted about the pivot 47, as a result of which the drive 32 and the drive side 33 of the mangle roll 10 are moved up and down on a virtually vertical path in order to move the mangle roll 10 into the mangle trough 12 and in order to move the mangle roll 10 out of the mangle trough 12.

The lever mechanism 31 on the non-driven side 34 of the mangle roll 10, designed in principle like the lever mechanism 30 on the drive side 33, also has a double lever 32, which can be pivoted about the pivot 44, and a single lever 49, which can be pivoted about the pivot 47. The double lever 48 can also be pivoted by a pneumatic cylinder 50. Between the opposite outer ends of the double lever 48 and at the free end of the single lever 49 a bearing 15 for the non-driven side 34 of the mangle roll 10 is attached. This bearing 51 is additionally connected to the free end of the single lever 49. In the bearing 51, a stub axle 53 that is firmly connected to the end wall 52 of the mangle roll 10, on the non-driven side 34 of the same is supported and, in the exemplary embodiment shown, is designed as a sleeve.

The lever mechanisms 30 and 31 are synchronized, to be specific by a compensating shaft 54 in the exemplary embodiment shown. The compensating shaft 54 is located on the pivot 44 for mounting the double levers 42 and 48 on the frame 15. The compensating shaft 54 therefore constitutes a torque-transmitting connection between the double levers 42 and 48 of the lever mechanisms 30 and 31 by transmitting the movement of one double lever 42 to the other double lever 48. In addition, the compensating shaft 54 also serves to implement the mounting of the double levers 42 and 48 on the frame 15. In order that the compensating shaft 54 ensures virtually identically equal pivoting of the double levers 42 and 48, the compensating shaft 54 is designed to be substantially torsionally rigid. This is achieved, for example, by means of appropriate dimensioning of the compensating shaft 54.

The double levers 42 and 48 of the different lever mechanisms 30 and 31 are designed with different lengths. Accordingly, the double lever 42 on the drive side 33 is somewhat shorter. The distances of the attachment of the bearing 51 for mounting the mangle roll 10 on the non-driven side 34 and of the angled epicyclic gearbox 36 for mounting the mangle roll 10 on the drive side 33 to the pivot 44 and to the compensating shaft 54 are equal. On the other hand, the distances of those points at which the pneumatic cylinders 46 and 50 are attached to the free ends of the double levers 42 and 48 to the pivot 44 or compensating shaft 54 are of different lengths. As a result, the pneumatic cylinder 50 on the non-driven side 34 is attached to the double lever 48 at a greater distance from the pivot 44 than the pneumatic cylinder 46 on the drive side 33. The different lengths of the double levers 42 and 48 lead to the forces with which the mangle roll 10 is pressed into the mangle trough 12 being substantially equal on both sides of the mangle roll 10 although on the drive side 33, because of the weight of the drive 32, a considerable proportion of the pressing force of the mangle roll 10 into the mangle trough 12 is produced by the weight of said drive 32. Since, on the non-driven side 34, the weight component of the drive 32 is missing, a greater pressing force has to be exerted here by the pneumatic cylinder 50, which is implemented by means of the longer double lever 48. The length ratios of the double levers 42 and 48 are coordinated with each other in such a way that the longer double lever 48 on the non-driven side 34 compensates for the weight, which is missing here, of the drive 32 on the drive side 33, specifically exerting a correspondingly higher force on the bearing 51 of the mangle roll 10 on the non-driven side 34.

Alternatively, it is conceivable to make the lever ratios of the lever mechanisms 30 and 31 different in another way, in order that the lever drive 30 on the drive side 33 presses the mangle roll 10 into the mangle trough 12 with lower forces than the lever mechanism 31 on the non-driven side 34.

It is also possible to design the double levers 42 and 48 to be equally long and, instead, to provide on the non-driven side 34 a pneumatic cylinder 50 with a greater piston area required to compensate for the weight of the drive 32.

As a result of the diameter of the mangle roll 10 of about 2000 mm, an elastic wrapping surrounding the mangle roll 10 is primarily more highly loaded in the circumferential direction than in the case of conventional trough mangles with smaller diameters of the mangle roll. For this reason, according to the invention a special wrapping is provided. This is formed of a single-layer felt 55 with a thickness of preferably 7 to 18 mm. The felt 55 per se can comprise a plurality of layers which are permanently connected to one another and which can have identical or else different characteristics. A material web of the felt 55 formed in this way is then laid completely once around the mangle roll 10, and the transverse edges of the material web are connected without offset at a connecting point 56, in particular spliced. To this end, the adjacent transverse edges of the felt 55, to be put together at the connecting point 56, are chamfered as viewed in the cross-sectional direction of the mangle roll 10 in order to form chamfered connecting faces 57. As a result of this chamfering, the wrapping at the connecting point 56 is exactly as thick as the felt 55 outside the connecting point 56. The connecting faces 57 of opposite end areas of the felt 55 for forming the wrapping are connected to each other at the connecting point 56, to be specific preferably by means of adhesive bonding or the like. Alternatively or additionally, the connection can also be made by means of sewing in the area of the connecting point 56.

List of designations:

| | | | |
|---|---|---|---|
| 10 | Mangle roll | 38 | End wall |
| 11 | Longitudinal mid-axis | 39 | Coupling flange |
| 12 | Mangle trough | 40 | Flange plate |
| 13 | Longitudinal edge | 41 | Splined profile |
| 14 | Longitudinal edge | 42 | Double lever |
| 15 | Frame | 43 | Single lever |
| 16 | Inlet side | 44 | Pivot |
| 17 | Outlet side | 45 | Piston-rod end |
| 18 | Swinging support | 46 | Pneumatic cylinder |
| 19 | Smoothing surface | 47 | Pivot |
| 20 | Drive direction of 10 | 48 | Double lever |
| 21 | Trough half | 49 | Single lever |
| 22 | Trough half | 50 | Pneumatic cylinder |
| 23 | Connecting line | 51 | Bearing |
| 24 | Inner trough plate | 52 | End wall |
| 25 | Outer trough plate | 53 | Stub axle |
| 27 | Flow duct | 54 | Compensating shaft |
| 28 | Connection | 55 | Felt |
| 29 | Longitudinal welded seam | 56 | Connecting point |
| | | 57 | Oblique connecting face |
| 30 | Lever mechanism | | |
| 31 | Lever mechanism | | |
| 32 | Drive | | |
| 33 | Drive side | | |
| 34 | Non-driven side | | |
| 35 | Output drive shaft | | |
| 36 | Angled epicyclic gearbox | | |
| 37 | Electric motor | | |

What is claimed is:

1. A trough mangle having rotary-driven mangle roll (10) and a flexible mangle trough (12) associated with the mangle roll (10), wherein:

a) the mangle trough (12) has a smoothing surface (19) on an inner side facing the mangle roll (10) across which laundry to be ironed is moved between the mangle roll (10) and the mangle trough (12);

b) the mangle trough (12) is resilient such that the mangle trough (12) nestles against a surface of the mangle roll (10) uniformly across the smoothing surface (19); and c) the mangle roll (10) has a diameter which is greater than 1600 mm.

2. The trough mangle as claimed in claim 1, wherein the mangle roll (12) has a diameter in the range from 1600 to 2600 mm.

3. The trough mangle as claimed in claim 1, wherein the mangle roll (12) has a diameter in the range from 1800 to 2400 mm.

4. The trough mangle as claimed in claim 1, wherein a drive side (33) of the mangle roll (10) is assigned a drive (32), and the drive (32) carries the mangle roll (10) on the drive side (33).

5. The trough mangle as claimed in claim 1, wherein the mangle trough (12) is formed of trough sections connected to one another.

6. The trough mangle as claimed in claim 1, wherein the mangle roll (10) has a wrapping which has a thickness between 6 and 25 mm.

7. The mangle trough as claimed in claim 6, wherein the wrapping of the mangle roll has a thickness of 12 to 25 mm.

8. The trough mangle as claimed in claim 6, wherein the wrapping is formed from a felt-like material.

9. The trough mangle as claimed in claim 1, wherein a drive side (33) of the mangle roll (10) is assigned a drive (32), and the drive (32) carries the mangle roll (10) on the drive side (33).

10. The trough mangle as claimed in claim 9, wherein the drive side (33) of the mangle roll (10) is mounted in the drive (32).

11. The trough mangle as claimed in claim 1, wherein a drive (32) of the mangle roll (10) has a gearbox selected from the group consisting of an epicyclic gearbox, an angled epicyclic gearbox (36), a cyclo gearbox, and a harmonic drive gearbox.

12. The trough mangle as claimed in claim 1, wherein the mangle roll (10) is connected to a frame (15) on both a drive side (33) and a non-driven side (34) opposite the drive side (33) such that the mangle roll (10) can pivot relative to both the drive side (33) and the non-driven side (34) via a lever mechanism (30, 31).

13. The trough mangle as claimed in claim 12, wherein the lever mechanisms (30, 31) on the drive side (33) and the non-driven side (34) are coupled to each other.

14. The trough mangle as claimed in claim 13, wherein the lever mechanisms (30, 31) are coupled to each other by means of a compensating shaft (54), which is dimensioned such that it is substantially torsion-free.

15. The trough mangle as claimed in claim 14, wherein the compensating shaft (54) is associated with a pivot (44) of a lever 42, 48) of the lever mechanisms (30, 31) on which the mangle roll (10) is mounted.

16. The trough mangle as claimed in claim 13, wherein the weight of the drive (32) mounted on the lever mechanism (30) on the drive side (33) is compensated for by the contact force of the mangle roll (10) on the mangle trough (12).

17. The trough mangle as claimed in claim 13, wherein the lever mechanisms (30, 31) on the drive side (33) and on the non-driven side (34) are pivotable by means of pressure-medium cylinders.

18. The trough mangle as claimed in claim 1, wherein the resilient mangle trough (12) is formed of individual trough sections connected to one another.

19. The trough mangle as claimed in claim 18, wherein the individual trough sections extend over part of the mangle trough (12) surrounding the mangle roll (10) in some areas in the circumferential direction.

20. The trough mangle as claimed in claim 18, wherein the individual trough sections are designed independently, at least with regard to their energy supply.

21. The trough mangle as claimed in claim 18, wherein the individual trough sections have their own connections, at least for the feed of energy.

22. The trough mangle as claimed in claim 21, wherein the connections of the individual trough section are connected in parallel with one another in terms of flow.

23. The trough mangle as claimed in claim 18, wherein the trough mangle (12) has two substantially identically designed trough sections.

24. The trough mangle as claimed in claim 23, wherein each of the identically designed trough sections is formed from a trough half (21, 22).

25. A trough mangle having a mangle roll (10) that is driven so as to revolve and a flexible mangle trough (12) associated with the mangle roll, wherein:

a) a drive side (33) of the mangle roll (10) is assigned a drive (32);

b) the drive (32) carries the mangle roll (10) on the drive side (33); and c) the drive (32) is an angled epicyclic gearbox (36).

26. A trough mangle having a rotary driven mangle roll (10) and a flexible mangle trough (12) associated with the mangle roll (10), wherein:

a) a drive side (33) of the mangle roll (10) is assigned a drive (32), and the drive (32) carries the mangle roll (10) on the drive side (33); and b) a drive-side end wall (38) of the mangle roll (10) is assigned a coupling flange (39) which is connected to an end wall (38) and which has a torque-transmitting means for connecting the mangle roll (10) to an output drive shaft (35) of the drive (32).

27. The trough mangle as claimed in claim 26, wherein the coupling flange (39) has a torque-transmitting means with a splined profile that corresponds to a flanged profile on the output drive shaft (35) of the drive (32).

28. A trough mangle having at least one rotary driven mangle roll (10) and a flexible mangle trough (12) associated with the mangle roll (10), wherein a drive (32) of the mangle roll (10) is an angled epicyclic gearbox (36).

29. A trough mangle having at least one rotary driven mangle roll (10) and a flexible mangle trough (12) associated with the mangle roll (10), wherein a drive (32) of the mangle roll (10) is cyclo gearbox.

30. A trough mangle having at least one rotary driven mangle roll (10) and a flexible mangle trough (12) associated with the mangle roll (10), wherein a drive (32) of the mangle roll (10) cyclo gearbox.

31. A trough mangle having at least one rotary driven mangle roll (10) and a flexible mangle trough (12) associated with the mangle roll (10), wherein:

a) the mangle roll (10) is connected to a frame (15) on drive side (33) and on a non-driven side (34) opposite the drive side (33) such that the mangle roll (10) can pivot via a lever mechanism (30, 31);

b) the lever mechanisms (30, 31) on the drive side (33) and the non-driven side (34) are coupled to each other and are pivotable by means of pressure-medium cylinders; and c) in order to compensate mechanically for the weight loading exerted by the drive (32) on the drive-side lever mechanism (30), the-lever ratios of lever mechanisms (30, 31) are dimensioned such that that a lever arm of the lever mechanism (30) on which the pressure-medium cylinder acts in each case is shorter than a corresponding lever arm of the lever mechanism (31) of the non-driven side (34).

32. A trough mangle having at least one rotary driven mangle roll (10) and a flexible mangle trough (12) associated with the mangle roll (10), wherein:

a) the mangle roll (10) is connected to a frame (15) on a drive side (33) and on a non-driven side (34) opposite the drive side (33) such that the mangle roll (10) can pivot via a lever mechanism (30, 31);

b) the lever mechanisms (30, 31) on the drive side (33) and the non-driven side (34) are coupled to each other and are pivotable by means of pressure-medium cylinders; and c) in order to compensate pneumatically for the weight loading exerted by the drive (32) on the drive-side lever mechanism (30), the pressure-medium cylinder associated with this lever mechanism (30) has a smaller piston area than that pressure-medium cylinder which is associated with the lever drive (31) of the non-driven side (34) of the mangle roll (10).

33. A trough mangle having a rotary driven mangle roll (10) and a flexible and resilient mangle trough (12) associated with the mangle roll (10), wherein:

a) the mangle trough (12) is formed of two substantially identical individual trough sections connected to one another, b) each of the trough sections is formed from a trough half (21, 22); and c) the trough halves (21, 22) are connected to each other by welding in the center of the mangle trough (12).

34. A trough mangle having a rotary driven mangle roll (10) and a flexible and resilient mangle trough (12) associated with the mangle roll (10), wherein:

a) the mangle trough (12) is formed of two substantially identical individual trough sections connected to one another;

b) each of the trough sections is formed from a trough half (21, 22); and c) the trough halves (21, 22) are connected to each other by a longitudinal welded seam (29) along a connecting line (23) running in the longitudinal direction of the mangle trough (12), and going through the lower vertex of the mangle trough.

35. The mangle trough as claimed in claim 34, wherein the longitudinal welded seam (29) is formed and dimensioned in such a way that it has approximately the same section modulus as the respective trough halves (21, 22).

36. A trough mangle having a rotary driven mangle roll (10) and a flexible mangle trough (12) associated with the mangle roll (10), wherein the angle roll (10) has a wrapping that has a thickness between 6 and 25 mm and the wrapping is formed in one layer.

37. A trough mangle having a rotary driven mangle roll (10) and a flexible mangle trough (12) associated with the mangle roll (10), wherein the angle roll (10) has a wrapping that has a thickness between 6 and 25 mm and the wrapping is closed endlessly in the circumferential direction of the mangle roll (10) by means of a connecting seam substantially without an offset.

38. A trough mangle having a rotary driven mangle roll (10) and a flexible mangle trough (12) associated with the mangle roll (10), wherein the mangle roll (10) has a wrapping which has a thickness between 6 and 25 mm and the wrapping is formed only from a felt-like material.

* * * * *